United States Patent [19]

Shipley

[11] Patent Number: 4,580,786

[45] Date of Patent: Apr. 8, 1986

[54] DEVICE FOR CONTROLLING GOLF SWING

[76] Inventor: Barry E. Shipley, 161 Jones Street, Ultimo, N.S.W. 2007, Australia

[21] Appl. No.: 574,030

[22] PCT Filed: May 18, 1983

[86] PCT No.: PCT/AU83/00064

§ 371 Date: Jan. 16, 1984

§ 102(e) Date: Jan. 16, 1984

[87] PCT Pub. No.: WO83/03981

PCT Pub. Date: Nov. 24, 1983

[30] Foreign Application Priority Data

May 20, 1982 [AU] Australia ..... PF4073

[51] Int. Cl.[4] ..... A63B 69/36

[52] U.S. Cl. ..... 273/191 R

[58] Field of Search ..... 273/191 R, 191 A, 191 B, 273/192, 186 R

[56] References Cited

U.S. PATENT DOCUMENTS

| | | | |
|---|---|---|---|
| 2,448,904 | 9/1948 | Millner | 273/191 R |
| 2,737,432 | 3/1956 | Jenks | 273/191 R |
| 3,604,712 | 9/1971 | Lansing et al. | 273/191 R X |
| 4,261,573 | 4/1981 | Richards | 273/191 R |
| 4,486,020 | 12/1984 | Kane et al. | 273/191 R |

*Primary Examiner*—George J. Marlo

*Attorney, Agent, or Firm*—Ladas & Parry

[57] ABSTRACT

A golf swing aid comprising an elongate member including first and second end extremities; a first attachment at the first extremity and a second attachment at the second extremity; the first attachment adapted to be fixed to a rigid object above ground height and to constrain the elongate member to revolve in a path defining a cone, wherein the angle of elevation of the cone axis and the cone angle are independently adjustably fixed; and the second attachment is adapted to be secured to the shaft of a golf club and to be selectively clamped tightly thereto or allowed to slide with minimal resistance longitudinally along the shaft, the second attachment further adapted to allow universal type pivotal movement between the elongate member and the shaft.

6 Claims, 5 Drawing Figures

FIG. 3
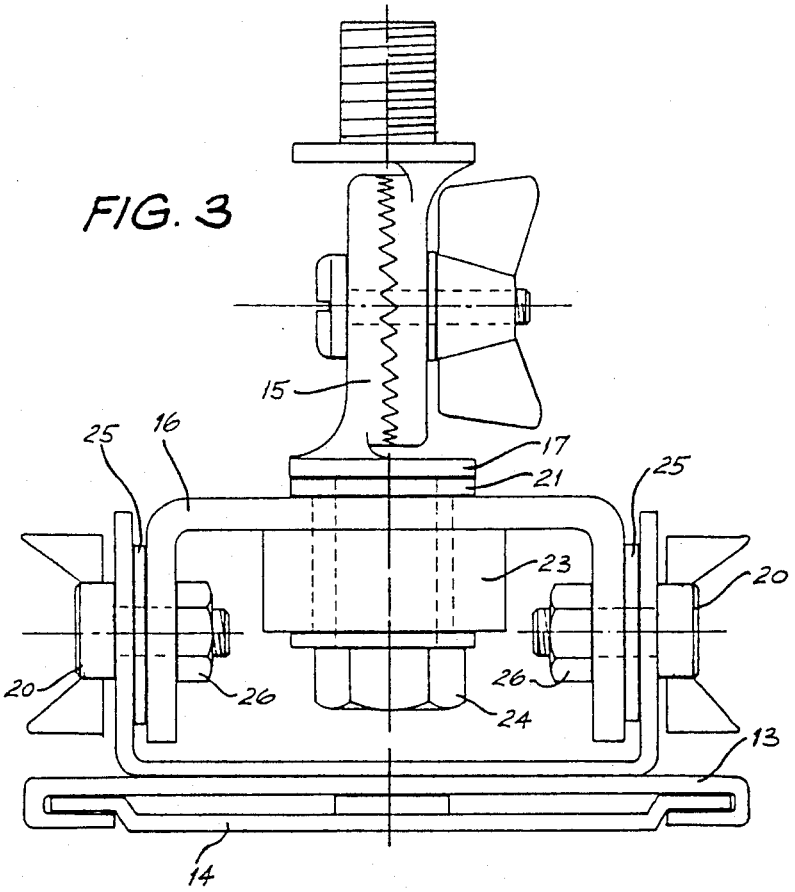
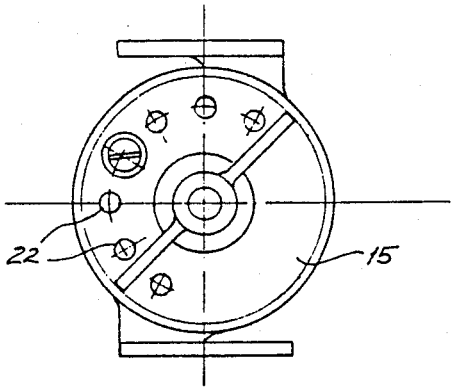
FIG. 4

DEVICE FOR CONTROLLING GOLF SWING

This invention relates to a device which aids a golf player in obtaining and maintaining a correct, or at least near correct, golf swing.

BACKGROUND ART

A number of devices have been known in the art which allow a golfer to practice his swing. Such devices have basically fallen into two categories: those which constrain the golf club in some manner; and those which do not constrain the golf club. Swing aids of the former type have generally been fairly large devices which take up considerable space and are relatively expensive to produce. Devices of the latter type, generally enjoy a much lower cost of production and smaller volume however they do not really serve the object of the present invention in that the club may still be swung through any trajectory.

DISCLOSURE OF INVENTION

It is therefore an object of the present invention to provide a golf swing aid which will overcome, or at least substantially ameliorate, the disadvantages of the foregoing prior art.

Accordingly, in one broad form, the present invention may be said to consist in a golf swing aid comprising: a substantially rigid member including first and second end extremities; a first joint, including attachment means, at said first end and providing relative pivotal movement between said attachment means and said member; a second joint, adapted to be attached to a golf club, at said second end and providing relative pivotal movement between said golf club and said member.

Preferably, the golf swing aid before described is used with said attachment means attached to a rigid vertical surface at a location substantially raised above ground level so that a golf club attached to said second joint may be swung in a normal manner while the lower portion of the shaft is constrained by said golf swing aid to follow a substantially planar trajectory.

BRIEF DESCRIPTION OF DRAWINGS

By way of example only, one embodiment of the present invention will now be described with reference to the drawings in which:

FIG. 3 shows the portion of FIG. 2 from an alternative angle;

FIG. 4 shows an alternative embodiment of the portion shown in FIGS. 2 and 3.

BEST MODE OF CARRYING OUT THE INVENTION

Figure 1:
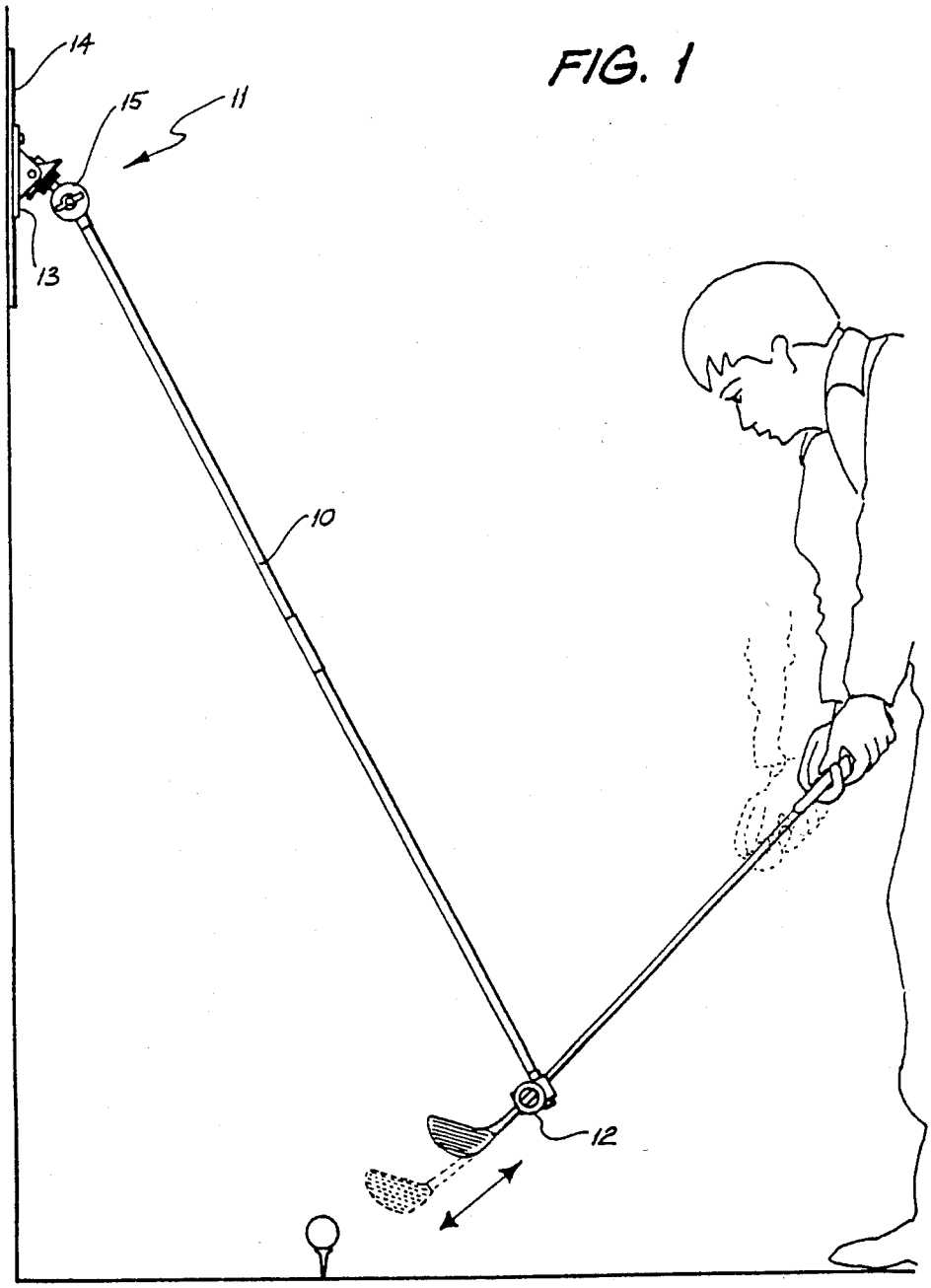
FIG. 1 is an perspective view of the apparatus while in use.
Figure 2:
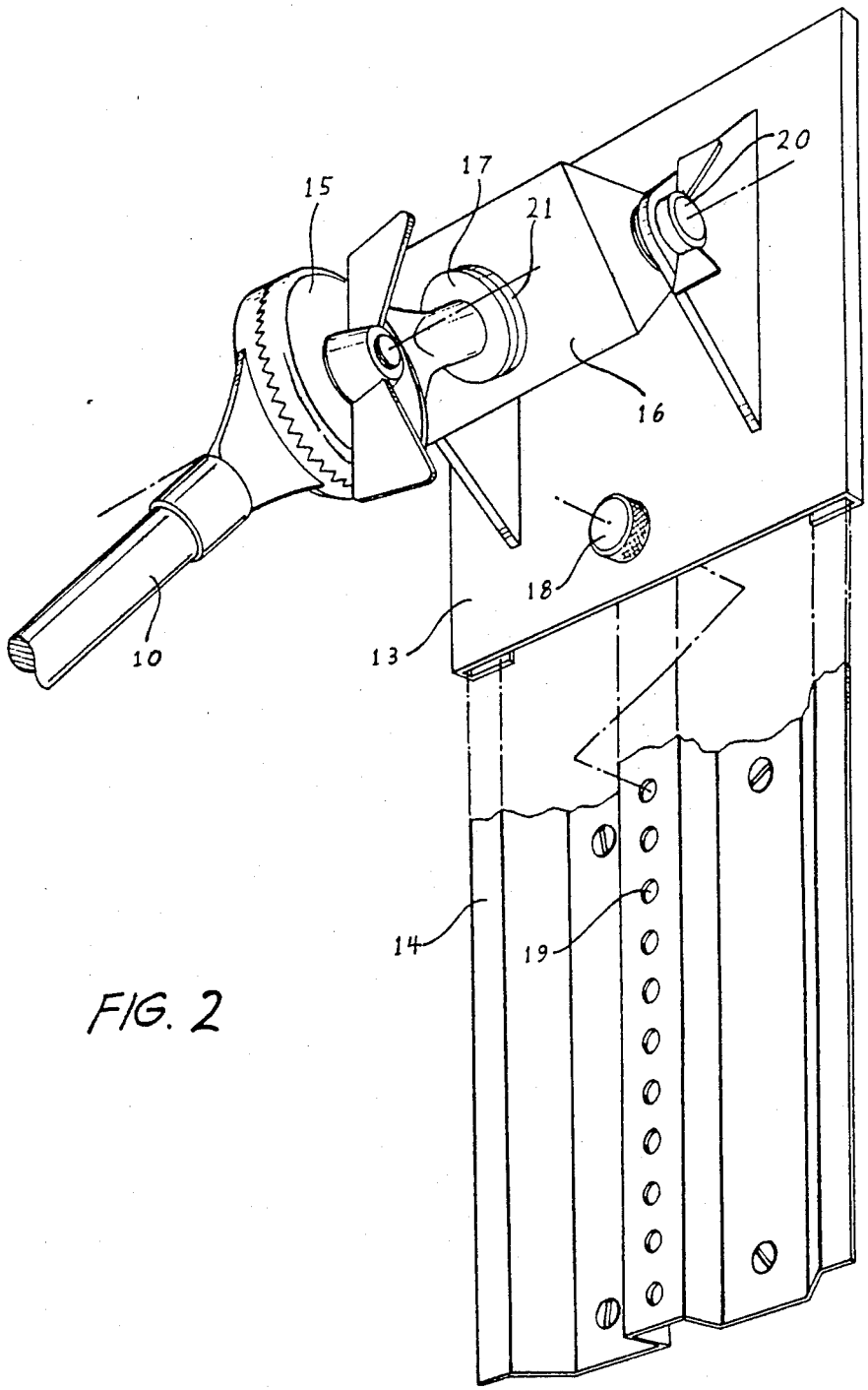
FIG. 2 shows one portion of the apparatus of FIG. 1.

Elongate member 10 includes pivotal joints 11 and 12 at its opposite extremities. Member 10 is produced in glass or carbon fibre reinforced plastics, aluminium extrusion or other suitably strong, preferably lightweight material. Pivotal joint 11 (FIG. 2) includes anchor plate 13 adapted to be slidingly engaged with a wall bracket 14. In use wall bracket 14 is attached to a vertical surface so that it extends substantially vertically and is some distance above the general ground level. Anchor plate 13 is adjustably fixed to wall bracket 14 by a suitable screw in threaded hole 18 co-operating with a suitable hole 19 so as to provide a vertical adjustment of the pivot 11.

Attached directly to rigid member 10 is an angle setting member 15 which is pivotally attached via bush 23 to an anchor pivot member 16. Anchor pivot member 16 is further attached to anchor plate 13 described above. Angle setting member 15 includes two disk portions superposed and relatively pivoted about a central axis. The co-operative faces of the two halves of angle setting member 15 are mutually fixed during use of the apparatus by radial serrations as clearly seen in FIG. 3, in an alternative form, or by inserting a screw into a hole 22 as shown in FIG. 4. As will further be described herein below angle setting member 15 provides a means for adjusting the important cone angle between the rigid member 10 and the pivot within bushing 23.

A second important angle which is adjustable, but fixed during operation of the apparatus, is between the anchor pivot member 16 and the anchor plate 13. By altering this angle the axis about which the whole apparatus rotates during use, that is the pivot axis in bushing 23, is set. Thus the swing angle, or angle of the plane in which the club is swung, is set. Frictional means 25 are provided between the co-operative surfaces of anchor pivot member 16 and anchor plate 13. These co-operative surfaces are clamped together via screw fasteners 20 or 26.

A third adjustment is provided in that anchor plate 13 can be positioned in any one of a large number of positions along wall bracket 14. The vertical height above ground at anchor plate 13 is set, as described above, so as to allow for different cone and swing angles. This will be further described.

Figure 5:
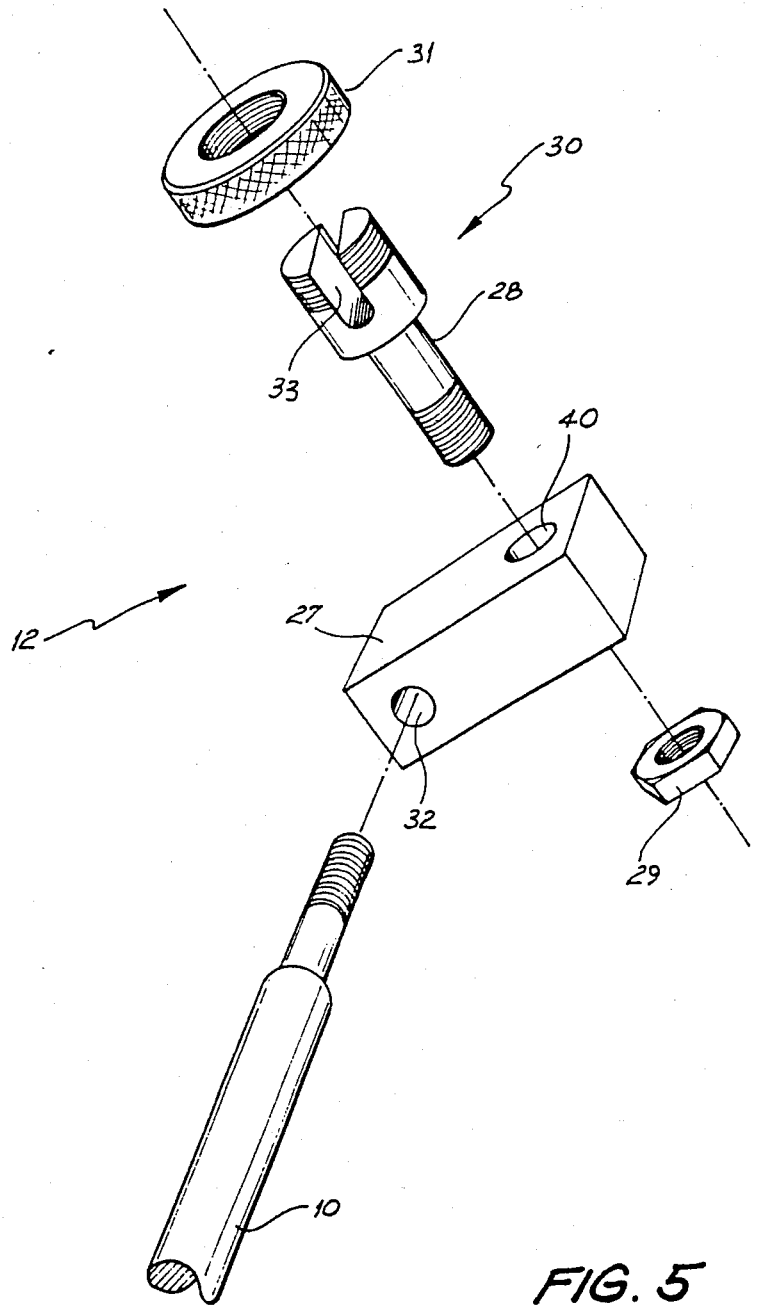
FIG. 5 shows a further portion of the apparatus of FIG. 1.

At the opposite end of member 10 is the second joint 12. Second joint 12 is most clearly shown in FIG. 5 and includes a joining member 27 adapted to be pivotally attached to the lower end of rigid member 10 via aperture 32. Also in joining member 27, and running perpendicular to aperture 32 is a second aperture 40. A stud portion 28 of clamping member 30 is adapted to be placed into aperture 40 and secured therein by co-operative nut 29. Shaft clamping member 30 includes a transverse slot 33 which is adapted to have the shaft of a golf club placed transversely therein, and to be secured by knurled ring nut 31 which is screwed onto the threaded surrounding of slot 33. Clamping member 30 is produced in suitable plastics material. It can be seen that slot 33 is transversely inwardly convergent. This feature helps prevent damage to the golf shaft, and further allows the shaft to travel in a limited manner transversely through slot 33 when knurled nut 31 is not particularly tight. A modification using a resilient ball or similar indented into the wall of slot 33 can help this travel to occur in a smooth manner. This is advantageous when using tapered shafts.

The object of the apparatus as a whole is to allow a person to practice a golf swing so that the club swings in a substantially planar circular or elliptical arc. The plane defined by this arc will be at an angle to the ground dependent upon the users height, the length of the club and the users general stance. The angle of this plane, or swing angle, is adjusted by the angle between anchor plate 13 and anchor pivot member 16. Preferably a angular scale is provided on one of these members 10 or 16 so as to allow the user to more quickly set the appropriate angle, having calculated same from a graph or chart compiled for this purpose, before use of the apparatus.

The diameter of the arc will depend upon the shaft length, the users arms length and the position at which second joint 12 is placed on the club shaft. This position is usually 6 to 9 inches from the head of the club. This diameter is set by the before mentioned cone angle.

In practice the actual trajectory may be slightly biplanar, as is performed by many skilled golfers. The club is constrained not at the head but a short distance up the shaft, at address and in early back swing a slight lowering of the shoulders and pulling in of the hands causes the head to follow a path slightly on the outside of the theoretical swing plane. At the top of the swing the player can straighten up bringing the club into the theoretical swing plane during the remainder of the stroke.

Further, as the shaft may slide within attachment means 30, the head may be pushed slightly out of the theoretical circle so as to describe more of an elliptical arc. Again this departure from the single plane circular swing is performed by a number of skilled players. Thus the shaft is kept on plane while the club may still travel along the target line in the conventional take-away.

As with the back swing, the apparatus allows a full follow-through although constraint against over-swing or collapse at the stance is applied.

In order to set up the apparatus for operation the vertical height above ground of anchor plate 13 is set in accordance with the height of the person who will be using the apparatus. Usually speaking the set height of anchor plate 13 will be lower for taller operators than for shorter ones. The height will further depend upon the size of the club to be used and in absolute turns the length of rigid member 10. As an example, in the preferred embodiment rigid member 10 is 6 foot in length and for a person of 5 foot ten inch high using a standard 42 inch wood the anchor plate 13 would be firstly set at approximately 6 foot above ground level. Angle setting member 15 would be adjusted to give a cone angle of 80° and anchor pivot member 16 set to give a plane angle such that the loose end of rigid member 10 is approximately 9 inches from the ground at its lowest point of the swing. The club can then be attached to joint 12 and from the address position a slow back swing is taken until the club head reaches the top of the back swing. Fastening means 20 and 26 are then tightened so as to set the anchor pivot member 16 rigidly to anchor plate 13. The club is then returned to the address position and knurl nut 31 may be somewhat loosened. During a slow swing it should be noted that club shaft can travel through the attachment means 30 and ideally the amount of club shaft projecting beyond clamp 30 is the same at address and at the top of back swing. If this is not found to be correct fine tuning is available by adjusting the vertical height of anchor plate 13.

As can be easily appreciated it is quite possible to construct a table which will readoff the appropriate settings for use on the apparatus in accordance with the operators height and club length. Of course such adjustments would purely be a starting point although they would probably be fairly close to the final settings used. The fine adjustment would normally be necessary to allow for example for similarly heighted people with different arm lengths.

The present invention has a number of important attributes. Firstly due to the simple nature the device is easily transported, especially if for example the rigid member 10 is produced in two sections threadably connected at its centre. Furthermore the apparatus may be used equally well by left and right handed operators without any extra adjustment required.

In use the apparatus forces the operator to extend and straighten the left arm (assuming a right handed player) and prevents collapse at the top of the back swing. Due to the geometry the user of the apparatus cannot overswing, the club can only be safely swung back to an approximately horizontal position. When the club is returned it follows a near perfect controlled arc substantially within a fixed plane from inside to the point of impact to a return position at the top of the follow-through. A swing whereby the club head is restrained to follow a substantially circular arc within a fixed plane has long been taught by professionals as being most desirable. Such swing greatly improves the chance of hitting the ball square and of having the club head travelling in the exactly desired direction at impact.

The above exemplified embodiment of the invention can of course incorporate a number of features which may be felt desirable in some circumstances. For example if the apparatus were to be used in tuition by professional golfers it may be desired to have electronic or mechanical sensing means incorporated proximate joint 11 and interacting with rigid member 10 to indicate such features as club head velocity at point of impact, momentum loss during impact (indicating momentum gained and therefore velocity of the bore), and number of swings. Similar sensing means might also be incorporated proximate joint 12 to detect movement of the golf shaft through clamping member 30.

Furthermore the present invention provides apparatus which may be used during practice of full strength swings without significantly affecting the users hitting power. Of course the apparatus may be used to actually hit a ball.

The pivotal joints 11 and 12 described above are the presently preferred embodiment but could be replaced by mechanically equivalent devices. Such might include suitable universal or ball and socket type joints so long as they possess the same degrees of freedom and preferably the angle setting abilities of the preferred joints.

The apparatus may also include its own stand so as to provide rigid anchoring of bracket 14. The stand may be for example a mobile tripod or a single pole rigidly held perpendicular to a frame adapted to lie flat on the ground.

Unlike most golf swing aid which constrain the movement of the club, the present apparatus normally creates no feeling of weight other than that of the club itself. However during warm-up it is sometimes desired to increase club weight (some people swing a couple of clubs together for this purpose) and this can be done by loosening angle setting member 15 allowing the weight of member 10 and pivot 12 to be felt.

What I claim is:

1. A golf swing aid device comprising: a substantially rigid member including first and second end extremities; attachment means for fixing the rigid member to a rigid body; a first joint at said first end of the rigid member comprising an anchor pivot member connected to said attachment means and adapted to lockably rotate about a horizontal axis, an angle setting member attached between said pivot member and said rigid member with said angle setting member adapted to freely rotate relative to said pivot member about a pivot axis perpendicular thereto, to be rigidly attached to said rigid member and to allow adjustment for setting the angle subtended between said pivot axis and said rigid member; and a seconsd joint adapted to be selectively fixedly or smoothly slidingly attached to the head end of a golf club shaft and to be secured to said second end of the rigid member providing relative pivotal movement between said golf club and said member.

2. A golf swing aid as in claim 1 wherein the anchor pivot member is connected to the attachment means through an anchor plate fixedly vertically slidably attached to said attachment means.

3. A golf swing aid as in claim 1 wherein the said second joint comprises a joining member attached to, and pivotable about, the longitudinal axis of said rigid member; a shaft clamping member secured to said joining member and pivotable about an axis perpendicular to said axis of said rigid member.

4. A golf swing aid as defined in claim 3 wherein said shaft clamping member includes a male threaded region at one extremity, said threaded region including a slot running across said region parallel to the thread axis of said region and adapted to receive a golf club shaft therein, an a co-operative female threaded device screwed onto said region and adapted to secure a shaft with said slot.

5. A golf swing aid as defined in claim 4 wherein said slot is transversely inwardly convergent.

6. A golf swing aid as defined in claim 5 wherein said shaft clamping member is produced in plastics material in at least the region of said slot.

* * * * *